US011492192B2

(12) United States Patent
Fore

(10) Patent No.: US 11,492,192 B2
(45) Date of Patent: Nov. 8, 2022

(54) SPRAY DELIVERY SYSTEM

(71) Applicant: PRECISION VALVE CORPORATION, Greenville, SC (US)

(72) Inventor: John B. Fore, Travelers Rest, SC (US)

(73) Assignee: Precision Valve Corporation, Greenville, SC (US)

( * ) Notice: Subject to any disclaimer, the term of this patent is extended or adjusted under 35 U.S.C. 154(b) by 0 days.

(21) Appl. No.: 17/525,485

(22) Filed: Nov. 12, 2021

(65) Prior Publication Data

US 2022/0144533 A1 May 12, 2022

Related U.S. Application Data

(60) Provisional application No. 63/112,748, filed on Nov. 12, 2020.

(51) Int. Cl.
*B65D 83/62* (2006.01)
*B65D 83/28* (2006.01)
*B65D 83/44* (2006.01)

(52) U.S. Cl.
CPC ..... *B65D 83/28* (2013.01); *B65D 83/44* (2013.01); *B65D 83/62* (2013.01)

(58) Field of Classification Search
CPC ..... B05B 1/3045; B05B 1/3415; B05B 1/341; B05B 1/3426; B05B 1/3431; B05B 1/3468; B05B 1/3478; B05B 1/34; B05B 11/3081; B05B 11/3083; B05B 11/3084; B65D 83/62
See application file for complete search history.

(56) References Cited

U.S. PATENT DOCUMENTS 3,628,733 A * 12/1971 Kahn ..... B65D 83/20 239/543
5,735,465 A * 4/1998 Laforcade ..... B05B 7/08 239/416.4

(Continued)

OTHER PUBLICATIONS

International Search Report dated Feb. 8, 2022 from International Patent Application No. PCT/US2021/059177, 2 pages.

(Continued)

*Primary Examiner* — Donnell A Long
*Assistant Examiner* — Randall A Gruby
(74) *Attorney, Agent, or Firm* — Ruggiero McAllister & McMahon LLC

(57) ABSTRACT

A spray delivery system with minimal pressure loss can is used with an aerosol container having a valve. The system includes a vertically extending conduit having an opening at a lowermost end conduit and two openings through a surface at an opposite end. The surface is disposed at an angle relative to a vertical. The system also has a first horizontally extending conduit communicating with the vertically extending conduit though one of the two openings and a second horizontally extending conduit fluidly communicating with the vertically extending conduit though the other one of the two openings. A manifold defines an inner annular volume and fluidly communicates with the first and second horizontally extending conduits. A spray nozzle insert is in fluid communication with the manifold. The spray nozzle insert has a plurality of blades that radiate inward and connect with a center round well having a sharp end.

15 Claims, 6 Drawing Sheets

(56) References Cited

U.S. PATENT DOCUMENTS

| | | | | |
|---|---|---|---|---|
| 6,419,168 | B1 * | 7/2002 | Thieleke | B25C 1/08 239/338 |
| 6,517,012 | B1 * | 2/2003 | Slowik | B05B 1/3436 239/464 |
| 9,284,112 | B2 * | 3/2016 | Ghavami-Nasr | B05B 7/0483 |
| 2003/0160113 | A1 | 8/2003 | Dobbs et al. | |
| 2006/0054634 | A1 | 3/2006 | Mekata | |
| 2011/0248099 | A1 * | 10/2011 | Ghavami-Nasr | B65D 83/48 239/463 |
| 2011/0303768 | A1 * | 12/2011 | Cornet | B05B 1/3436 239/463 |
| 2012/0085779 | A1 | 4/2012 | Stern et al. | |
| 2012/0312897 | A1 | 12/2012 | Yamamoto et al. | |
| 2014/0291423 | A1 | 10/2014 | Gopalan et al. | |
| 2022/0106103 | A1 * | 4/2022 | Banovich | B65D 83/20 |

OTHER PUBLICATIONS

Written Opinion dated Feb. 8, 2022 from International Patent Application No. PCT/US2021/059177, 5 pages.

* cited by examiner

SPRAY DELIVERY SYSTEM

CROSS-REFERENCE TO RELATED APPLICATIONS

This application claims the benefit of U.S. Provisional Application Ser. No. 63/112,748, filed Nov. 12, 2020, the entire contents of which are incorporated by reference herein.

BACKGROUND

1. Field of the Disclosure

The present disclosure is directed to a spray delivery system for an actuator used in an aerosol product dispenser. More particularly, the present disclosure relates such a spray delivery system for a high viscous product that minimizes pressure loss and enhances mechanical breakup of product.

2. Description of Related Art

Aerosol systems dispense a variety of products from a container. In traditional aerosol dispensers, the product to be dispensed is mixed in a solvent and a propellant. In bag on valve (BOV) dispensers, product to be dispensed and propellant are separated by a bag welded to the valve. In both types, product is stored at a pressure in the container and dispensed via a nozzle upon actuation of a valve. Accordingly, the product to be dispensed can exist in in one or more (gas, liquid) phases or partial phases and in an emulsified state.

Product is dispensed as a plurality of atomized drops or particles of a fluid. Over time, pressure in the can reduces, in part due to a volume increase resulting from product being dispensed, also referred to a pressure loss from expansion. In part, some gas is inevitably released together with the product.

It is desirable that the atomized drops have or form a uniform pattern in the direction of flow. For example, the atomized drops can be in a flat, cone, or fan-like pattern.

There exists a problem with current aerosol systems when the product to be dispensed has a high viscosity.

First, pattern uniformity decreases as the container empties, rendering the portion of product dispensed properly to be significantly less than the total amount of product in the container.

Second, pattern uniformity decreases while pressure loss increases as product viscosity increases.

Moreover, the problem is further compounded because product viscosity is a function of environmental variables like temperature that are not always controllable.

SUMMARY

The present disclosure provides a spray delivery system that enables a high viscosity product to be dispensed from a container in a uniform pattern of atomized drops.

The present disclosure also provides that the spray delivery system facilitates mechanical breakup of high viscous product.

The present disclosure further provides a spray delivery system with a dual channel geometry that feeds a spray nozzle with minimal pressure drop.

The present disclosure yet further provides that the spray delivery system atomizes high viscous product into a uniform flat, cone, or fan-like pattern.

The present disclosure still further provides a spray delivery system that reduces pressure loss in a container and atomizes high viscous product into a uniform flat, cone, or fan-like pattern throughout a lifespan of the container.

The present disclosure also provides a method of dispensing a high viscosity product from a container.

BRIEF DESCRIPTION OF THE FIGURES

The accompanying drawings illustrate aspects of the present disclosure, and together with the general description given above and the detailed description given below, explain the principles of the present disclosure. As shown throughout the drawings, like reference numerals designate like or corresponding parts.

DETAILED DESCRIPTION

Figure 1:
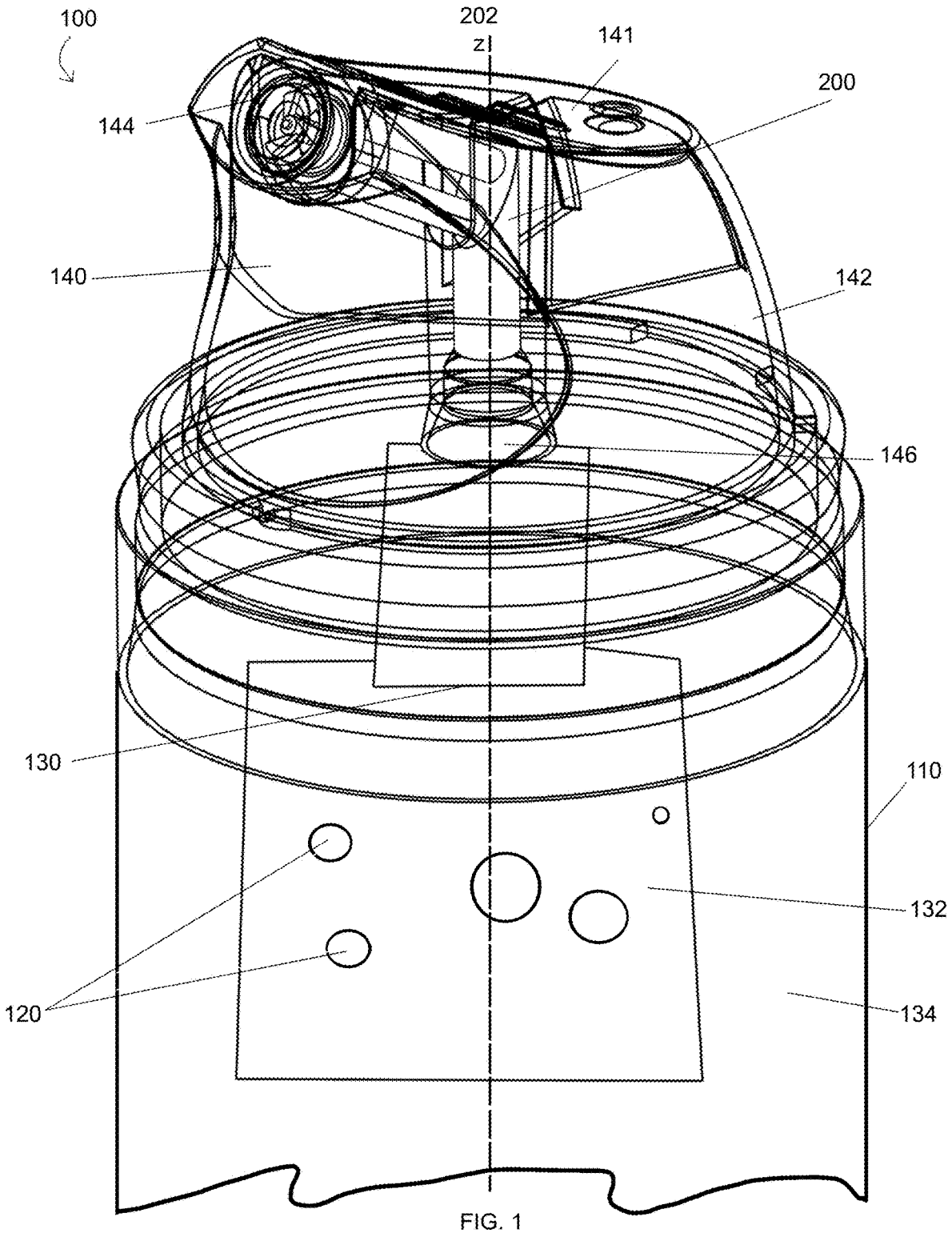
FIG. 1 is a perspective view of an actuator, spray delivery system, and container components of the system and method according to the present disclosure.

Referring to the drawings, and in particular to FIG. 1, a dispensing system according to the present disclosure is shown and generally referenced by reference numeral 100.

System 100 includes a container 110 with product 120 to be dispensed that is under pressure. The container 110 is operatively connected by a valve 130 to an actuator 140 that discharges product 120 through a spray delivery system 200. Container 110, valve 130, actuator 140, and spray delivery system 200 are in axial alignment along a common z axis, axis 202.

Valve 130 is directly, or by socket 146, connected in fluid communication with a lower end of spray delivery system 200. Valve 130 is shown as a BOV type valve having a bag 132 so that product 120 is isolated from propellant 134.

Valve 130 can also be a traditional valve. In such embodiments, product 120 is mixed with propellant 134.

Actuator 140 has wall structures. The wall structures are a circumferential surface 142, a top surface 141 with an opening 144 and a socket 146. Socket 146 is seated in operative communication with valve 130. Opening 144 is in fluid communication with an upper end of spray delivery system 200.

Spray delivery system 200 enables a high viscosity product to be dispensed from container 110 in a uniform pattern of atomized drops. Spray delivery system 200 also facilitates mechanical breakup of high viscous product 120 to atomizes high viscous product into a uniform flat, cone, or fan-like pattern. Spray delivery system 200 further reduces pressure loss throughout a lifespan of container 110.

Thus, in operation, product flows from container 110, through valve 130 and spray delivery system 200 prior to discharge from opening 144.

Figure 2:
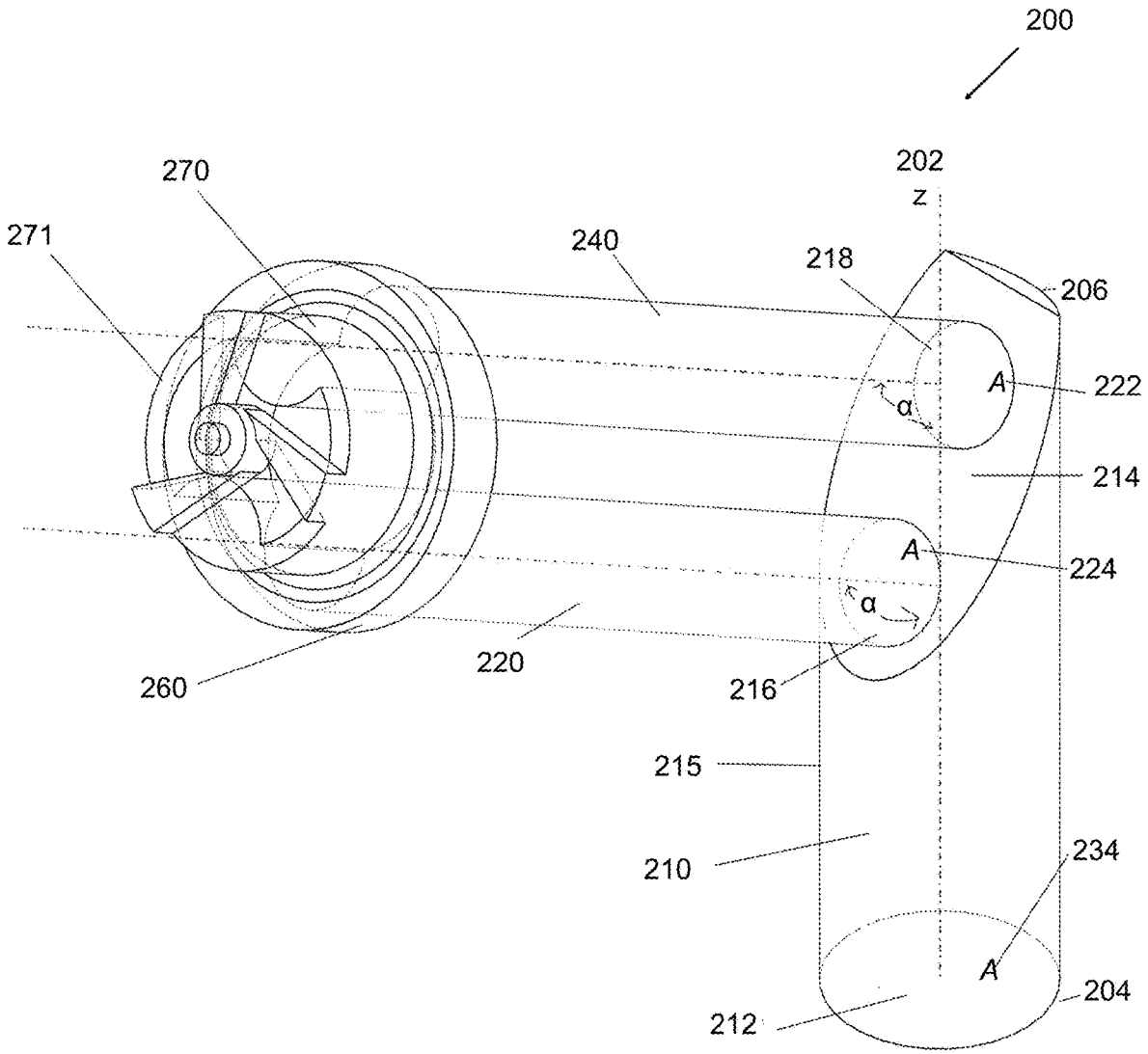
FIG. 2 is a perspective view of the spray delivery system of FIG. 1.
Figure 3:
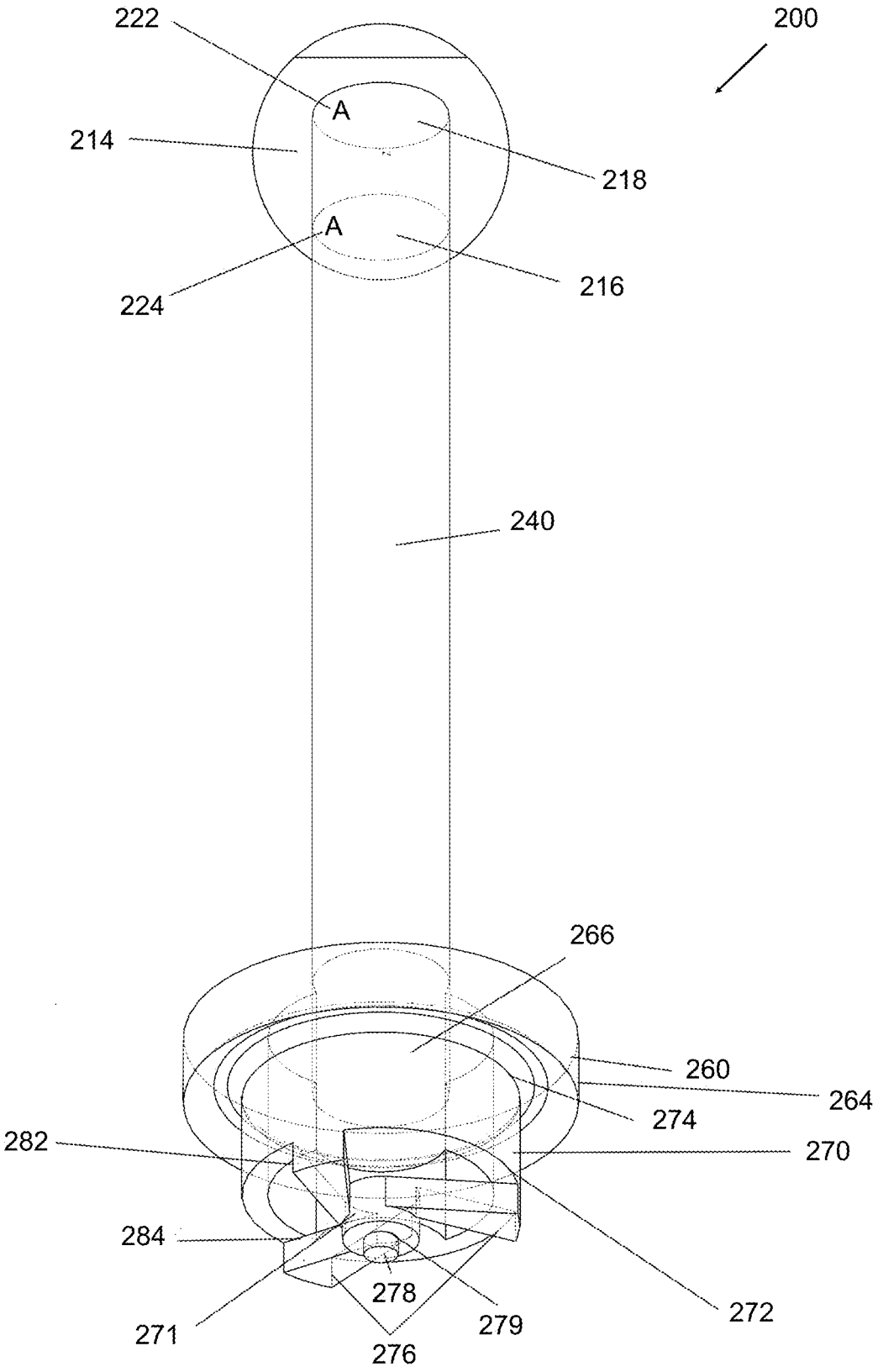
FIG. 3 is a top view of the spray delivery system of FIG. 1

Referring to FIGS. 2 and 3, spray delivery system 200 has an elongate hollow member that extends vertically, namely conduit 210.

Conduit 210 is connected to a pair of conduits 220 and 240 that extend horizontally from conduit 210 at an angle from 90° to 180°.

Conduits 210, 220 and 240 are shown as circular conduits. It will be appreciated that conduits 210, 220 and 240 can be triangular, rectangular, and the like.

In examples, conduits 220 and 240 are parallel.

The distal ends of conduits 220 and 240 are joined together at or in a manifold 260. Manifold 260 is connected to a conduit 270 having a spray insert 271 at an opposite end thereof so that product is dispensed therefrom.

Conduit 210 has an inner and outer diameter. Conduit 210 extends vertically along an axis 202 coincident with axis z from a lower end 204 and respective upper end 206. Extending from lower end 204 to upper end 206 is a wall 215 of conduit 210 that has a smooth interior surface.

At lower end 204, conduit 210 has an opening 212. Opening 212 has a cross-sectional area 234 through which fluid flows.

In examples, cross-sectional area 234 is constant along an entire length of conduit 210. In other examples, cross-sectional area 234 varies along the length of conduit 210. In yet other examples, cross-sectional area 234 varies along a portion of the length of conduit 210.

Conduit 210 is capped at upper end 206 by a surface 214. Surface 214 has two openings, namely opening 216 and opening 218.

Extending from openings 216 and 218 are conduits 220 and 240, respectively.

Conduits 220 and 240 preferably extend parallel to each other. Conduits 220 and 240 can also be substantially parallel to each other, namely within 3.04° of parallel, preferably within 1.36° of parallel, and most preferably within 0.96° of parallel Conduits 220 and 240 each have a length that extends from surface 214 to manifold 260. Conduits 220 and 240 are disposed along the length at angle $\alpha$ relative to z axis 202.

In examples, angle $\alpha$ can be 90° so that conduits 220 and 240 are normal to conduit 210.

In other examples, angle $\alpha$ can be 180° so that conduits 220 and 240 are parallel to conduit 210.

As shown, conduits 220 and 240 are vertically aligned. In other examples, conduits 220 can be horizontally aligned, or not aligned.

In still other examples, angle $\alpha$ ranges from 90° to 180°, preferably from 100° to 160°, more preferably 110° to 130° and more preferably 115° to 125°.

In the example shown, conduit 220 has an inner diameter that defines a cross-sectional area 224 for fluid flow that is constant along an entire length of conduit 220. Likewise, conduit 240 has an inner diameter that defines cross-sectional area 244 that is constant along an entire length of conduit 240.

In another example, cross-sectional area 224 varies along the length of conduit 220.

In yet another example, cross-sectional area 244 varies along the length of conduit 240.

In still yet another example, cross-sectional area 224 varies along the length of conduit 220 and cross-sectional area 244 varies along the length of conduit 240.

In some examples, cross-sectional areas 224 and 244 have an identical cross-sectional area.

In other examples, cross-sectional area 234 has a cross-sectional area that is about the same as a summation of cross-sectional areas 224 and 244.

In other examples, cross-sectional area 234 has a cross-sectional area that is within 5%, 10% or 15% of a summation of cross-sectional areas 224 and 244.

While spray delivery system 200 is shown having two conduits 220 and 240, spray delivery system 200 can have three, four, or more such horizontally extending conduits.

Figure 4:
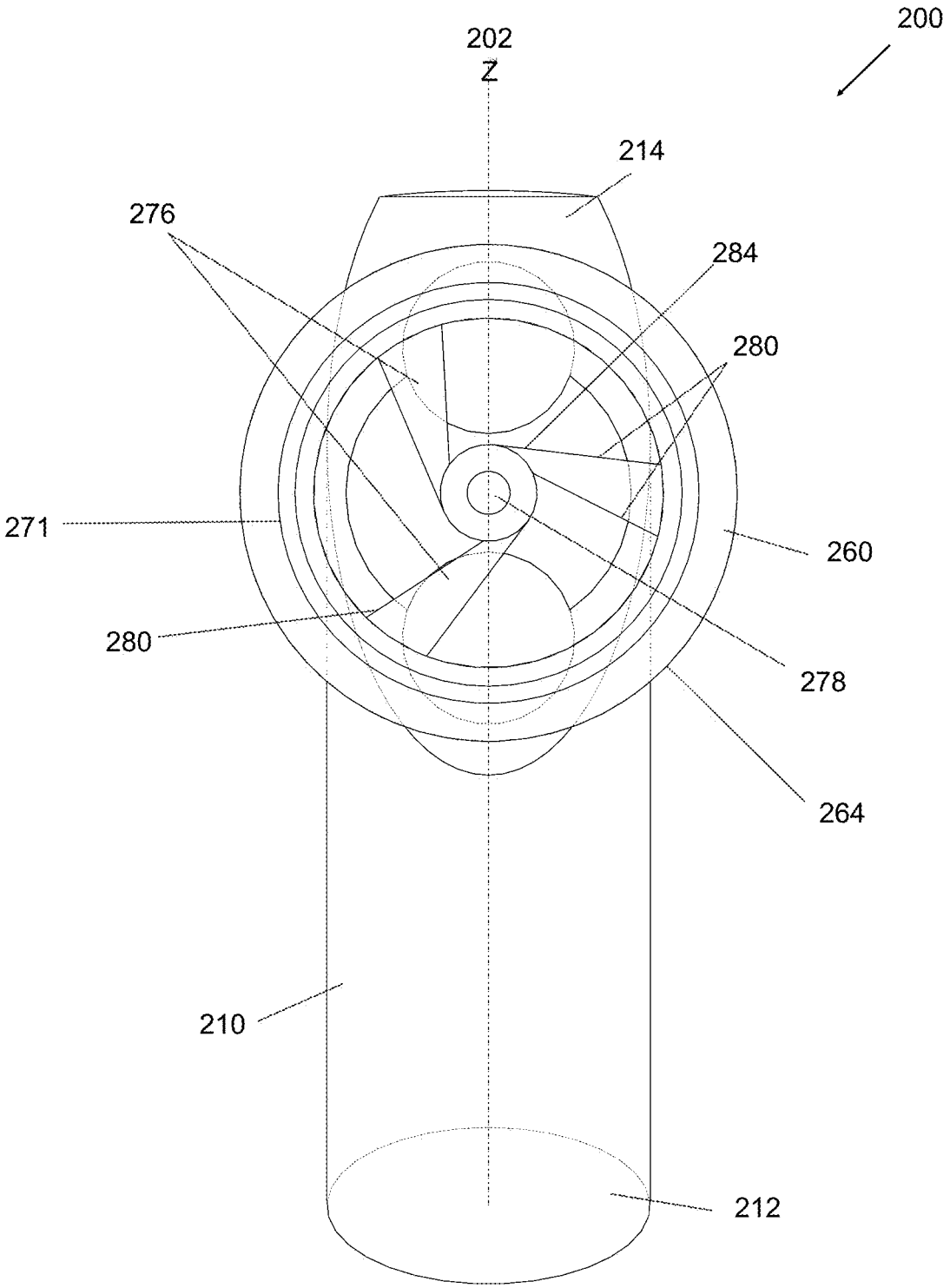
FIG. 4 is a front view of the spray delivery system of FIG. 1 taken normal to a direction of product flow.

Referring to FIGS. 3 and 4, flow from conduits 220 and 240 is joined in manifold 260. Manifold 260 has a diameter and wall structure 264 that define an inner annular volume.

Manifold 260 is connected to conduit 270 via an opening 266. Conduit 270 has a distal end 272 and a proximal end 274. Proximal end 274 connects to manifold 260. Product is discharged from a nozzle insert 271 at distal end 272.

Nozzle insert 271 has two or more blades 276. Blades 276 radiate inward to connect with a center round well 278. Center round well 278 can have a sharp edge 279.

Blades 276 have a surface 286. Blades 276 also have sharp edges 280, a depth 282, and a surface 286. Blades 276 can have an edge 284 that is tangent to a circumferential surface of center round well 278.

Blades 276 are preferably equally spaced about center round well 278. In preferred examples, there are three blades 276. However, there can be one, two, four, or more blades 276.

Together with center round well 278, blades 276 and sharp edge 279 generate a Borda-Carnot effect.

Without wishing to be bound by a single theory, a spray delivery system with a dual channel geometry can feed a spray nozzle with minimal pressure loss. The spray nozzle thus has more energy for mechanical breakup of product.

Although described herein as a propellent based BOV system, system 100 can be a non-propellent based system such as a hand pump dispensing system and or a traditional valve system.

Figure 5:
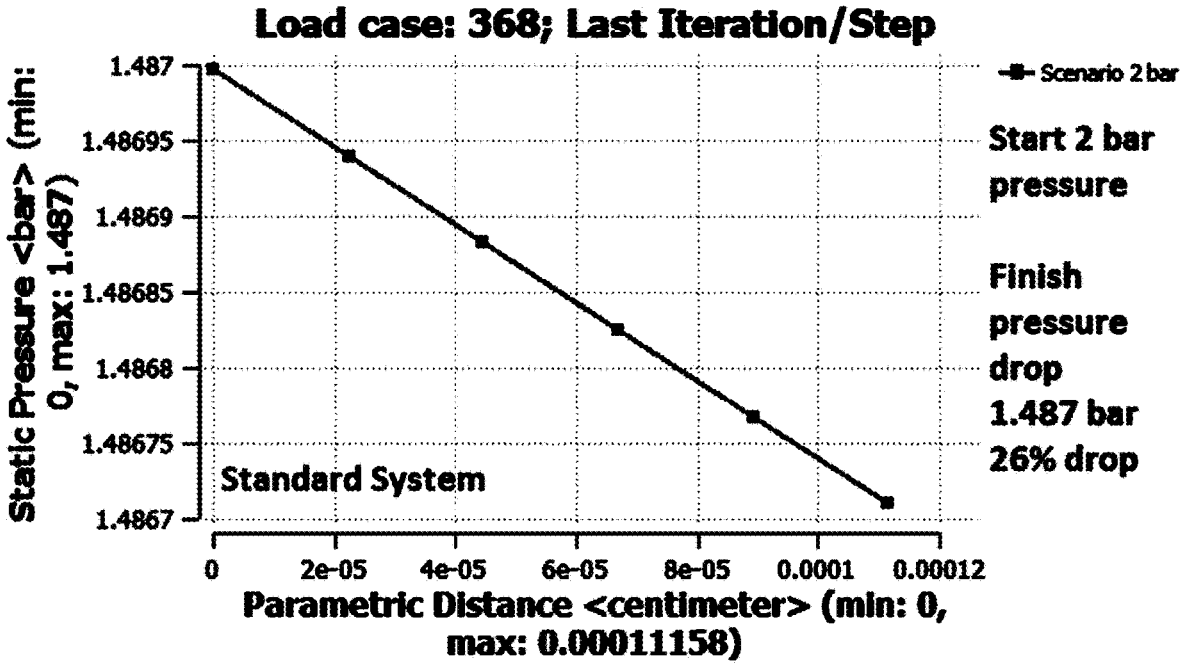
FIG. 5 is a comparison between a standard dispensing system and a spray delivery system according to the present disclosure at 2 bar pressure.
Figure 5:
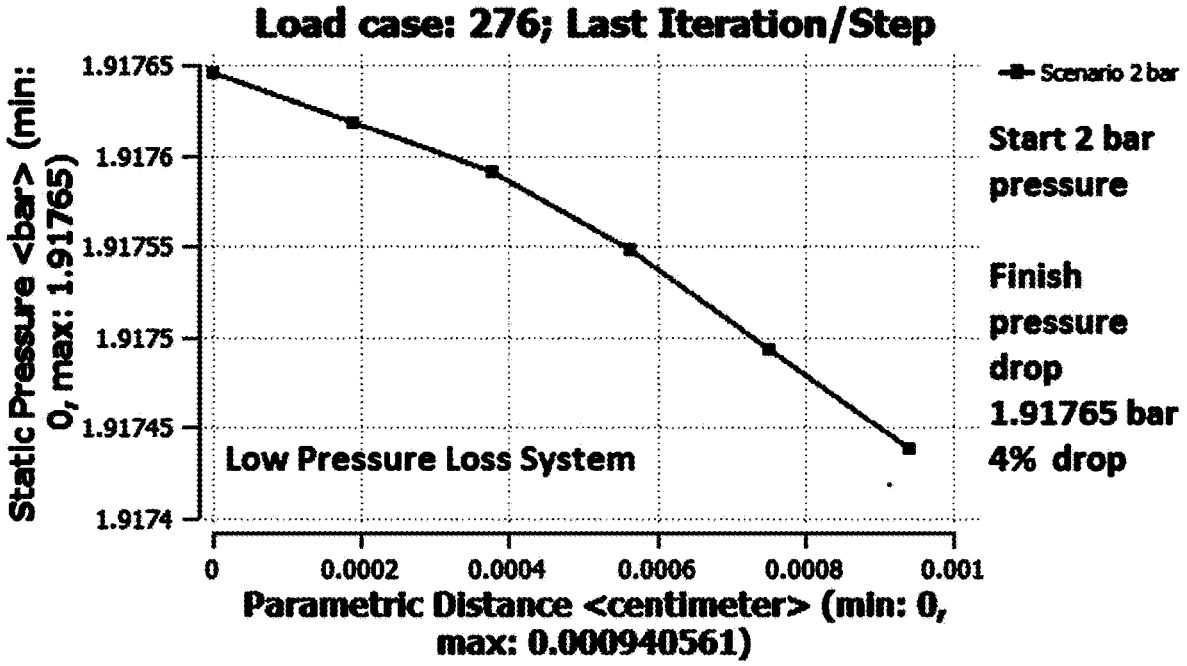
Figure 6:
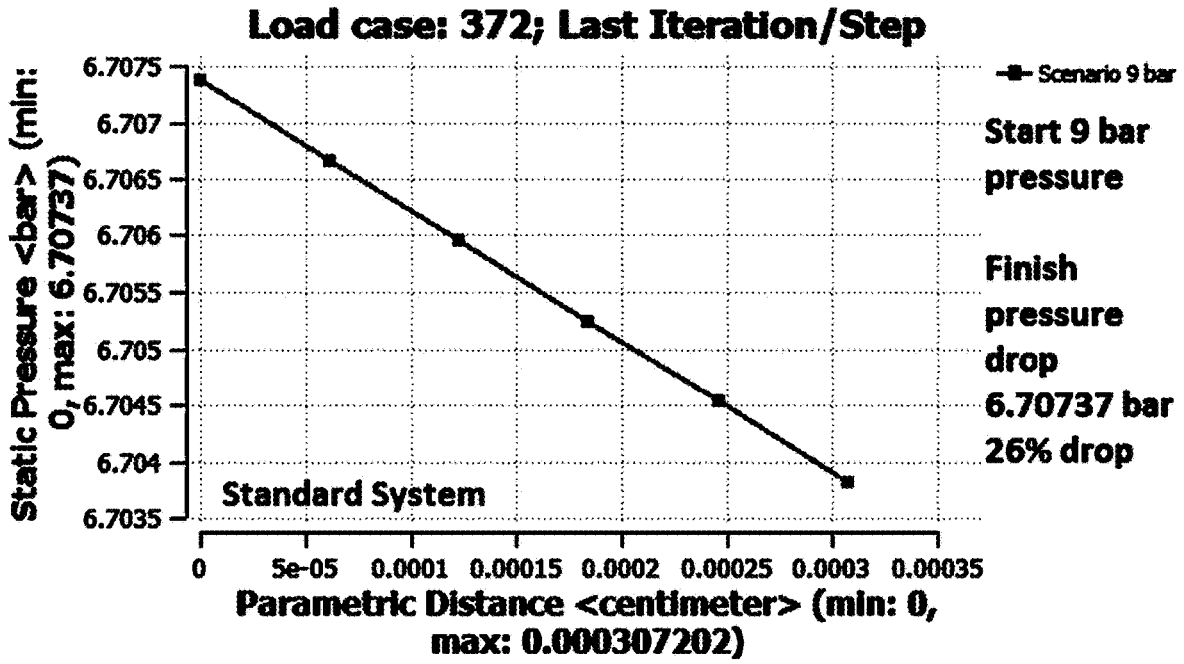
FIG. 6 is a comparison between a standard dispensing system and a spray delivery system according to the present disclosure at 9 bar pressure.
Figure 6:
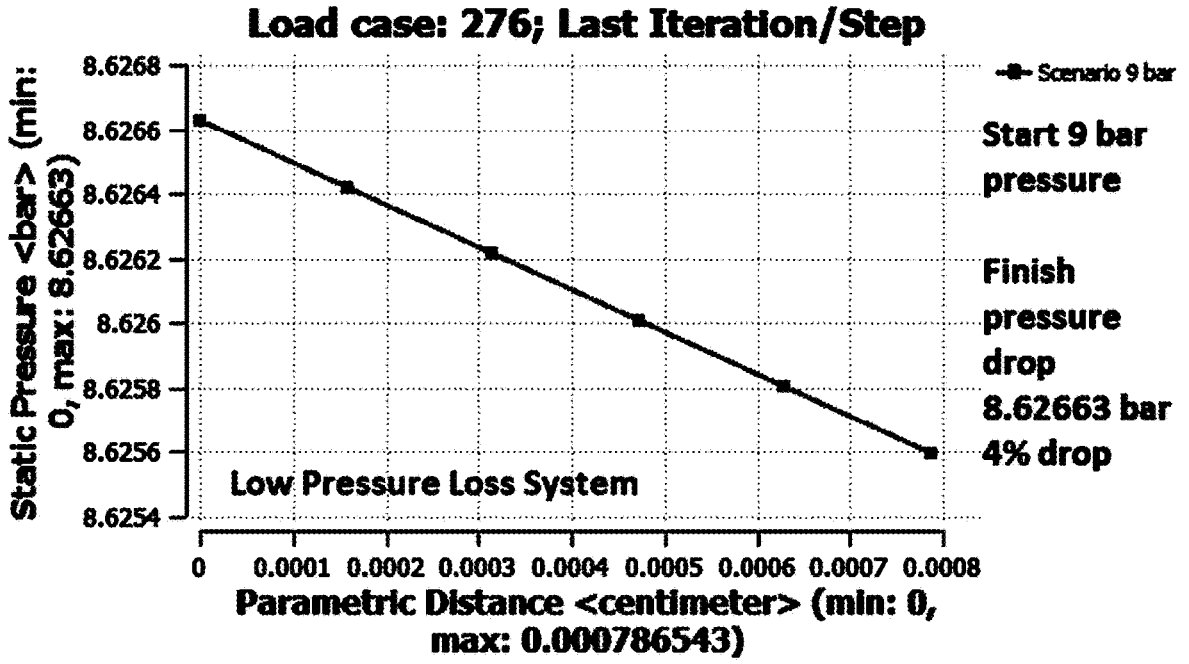

Referring to FIGS. 5 and 6, there is shown comparative computational fluid dynamics (CFD) studies between a dispensing system with standard or conventional inserts and a dispensing system having the present spray delivery system 200, referred to in the diagram as a low-pressure loss system.

These studies were performed using Olive Oil at 21° C., (room temperature). As shown, the standard design has a pressure loss of 26% as compared to system 100 with spray delivery system 200 that has a loss of just 4%.

Without wishing to be bound by a single theory, conduit, manifold, and blade structures of spray delivery system 200 minimize press loss at the head to provide more energy for mechanical breakup of the product. Spray delivery system 200 conserves energy until discharge where energy is maximized for mechanical breakup enabling high viscosity fluids to be dispensed.

While the present disclosure has been described with reference to one or more exemplary examples, it will be understood by those skilled in the art, that various changes can be made, and equivalents can be substituted for elements thereof without departing from the scope of the present disclosure. Therefore, it is intended that the present disclosure will not be limited to the particular examples disclosed herein.

The invention claimed is:

1. A spray delivery system with minimal pressure loss for use with an aerosol container having a valve, the system comprising:

a vertically extending conduit and two openings through a surface at an end opposite the lowermost end, wherein the surface is disposed at an angle relative to a vertical axis of the vertically extending conduit;

a first horizontally extending conduit extending from a distal end that is distal to the vertically extending conduit and fluidly communicating with the vertically extending conduit through the opening at the lowermost end and one of the two openings through the surface;

a second horizontally extending conduit extending from a distal end that is distal to the vertically extending conduit and fluidly communicating with the vertically extending conduit through the opening at the lowermost end and the other one of the two openings through the surface;

a manifold defining an inner annular volume and fluidly communicating with the first and second horizontally extending conduits; and a spray nozzle insert that is in fluid communication with the manifold, wherein the spray nozzle insert comprises a plurality of blades that radiate inward and connect with a center round well having a sharp edge.

2. The spray delivery system of claim 1, wherein the first and second horizontally extending conduits are disposed normal to the two openings.

3. The spray delivery system of claim 2, wherein the angle is from 100° to 160°.

4. The spray delivery system of claim 3, wherein the angle is from 110° to 130°.

5. The spray delivery system of claim 1, wherein the vertically extending conduit has constant cross-sectional area.

6. The spray delivery system of claim 1, wherein the vertically extending conduit has a cross-sectional area that varies along a portion of a total length thereof.

7. The spray delivery system of claim 1, wherein the vertically extending conduit has a cross-sectional area that varies along a total length thereof.

8. The spray delivery system of claim 1, wherein the vertically extending conduit has a cross-sectional area that is about the same as a summation of a cross-sectional area of both the first and second horizontally extending conduits.

9. The spray delivery system of claim 1, wherein the first and second horizontally extending conduits are substantially parallel to each other.

10. The spray delivery system of claim 1, wherein the first and second horizontally extending conduits each have a cross-sectional area that varies along a portion of a total length thereof.

11. The spray delivery system of claim 10, wherein the first and second horizontally extending conduits each have a cross-sectional area that varies along a total length thereof.

12. The spray delivery system of claim 1, wherein the center round well, plurality of blades, and sharp edge are configured to generate a Borda-Carnot effect.

13. The spray delivery system of claim 1, wherein the plurality of blades comprises three blades.

14. The spray delivery system of claim 1, wherein each blade of the plurality of blades comprises an edge that is tangent to the center round well.

15. The spray delivery system of claim 1, wherein the system is configured for a propellent based bag on valve system.

* * * * *